United States Patent [19]

Tomioka

[11] 4,160,401

[45] Jul. 10, 1979

[54] STRING VIBRATION TRANSDUCER BRIDGE FOR ELECTRIC STRINGED INSTRUMENTS

[75] Inventor: Michiaki Tomioka, Koufu, Japan

[73] Assignee: Chushin Gakki Seizo Kabushiki Kaisha, Nagano, Japan

[21] Appl. No.: 841,366

[22] Filed: Oct. 12, 1977

[30] Foreign Application Priority Data

Dec. 29, 1976 [JP] Japan ..... 51-160007

[51] Int. Cl.[2] ..... G10H 3/00

[52] U.S. Cl. ..... 84/1.16; 84/298; 84/307; 84/DIG. 24

[58] Field of Search ..... 84/1.14, 1.15, 1.16, 84/297, 298, 299, 307, DIG. 18, DIG. 24

[56] References Cited

U.S. PATENT DOCUMENTS

| | | | |
|---|---|---|---|
| 2,968,204 | 1/1961 | Fender | 84/1.15 |
| 3,178,501 | 4/1965 | Evans | 84/1.14 |
| 3,530,228 | 9/1972 | Scherer | 84/1.16 |
| 3,600,497 | 8/1971 | Zanessi | 84/DIG. 24 |
| 3,948,138 | 4/1976 | Gunn | 84/DIG. 24 |
| 4,031,799 | 6/1977 | Fender | 84/298 |
| 4,069,732 | 1/1978 | Moskowitz | 84/1.14 |

*Primary Examiner*—J. V. Truhe
*Assistant Examiner*—Leonard W. Pojunas, Jr.
*Attorney, Agent, or Firm*—Koda and Androlia

[57] ABSTRACT

A string vibration transducer bridge for an electric string instrument including a plurality of string tension mechanism provided side by side in the bridge and which are adjustably movable along the direction of the string and includes a plurality of string supporting electrode parts which are slidably movable along the direction of the string and rotatable along a direction perpendicular to the string, a plurality of independent piezoelectric transducers which each engage with an undersurface of an electrode part, and a plurality of piezoelectric transducer pushing mechanisms for pushing the piezoelectric transducers against the electrode parts whereby the tension of the string may be adjusted by both the string tension mechanism and the transducer pushing mechanism and the vibration from each string is independently sensed.

6 Claims, 8 Drawing Figures

STRING VIBRATION TRANSDUCER BRIDGE FOR ELECTRIC STRINGED INSTRUMENTS

BACKGROUND OF THE INVENTION

1. Field of Invention

This invention relates to string vibration transducers for electric stringed instruments.

2. Prior Art

Among conventional string vibration transducer bridges for electric stringed instruments, e.g. electric guitars, there have been some models in which an independent pickup for detecting string vibrations is installed for each string. Such systems, however, are characterized in that only the detection of string vibrations is done on a string-by-string basis, with the output signal of each pickup being sent out of the electric guitar via a common lead line. Accordingly, the principal purpose of the pickups is simply to efficiently convert the string vibrations into electrical signals regardless of the type of material from which the strings are made. For this reason, even when other devices are used in combination with electric guitars employing such a conventional bridge, it is absolutely impossible for the player to (a) adjust the output on a string-by-string basis, (b) accentuate the vibrations of specific strings while playing, or (c) adopt a playing technique in which an electrical signal representing a clear chord is obtained while attacking the strings as a whole.

Furthermore, in the case of pickups installed in conventional bridges, only the string-supporting part of each pickup is designed to be movable. Accordingly, since the piezo-electric device contained in each pickup remains in a fixed position when the strings are tuned, the direction from which pressure is applied to the piezoelectric device varies according to the movement of the string-supporting part. It is therefore impossible to convert string vibrations into electrical signals under identical conditions in every instance, and this results in a disadvantage of some variation in tone quality and output level every time the strings are tuned.

SUMMARY OF THE INVENTION

Accordingly it is a general object to provide a means for independently securing the vibration of each string of a string musical instrument.

It is another object of the present invention to provide a means which allows the player to accentuate the sensed vibrations of a particular string or strings.

It is yet another object of the present invention to provide a means for sensing the vibration of each string which has substantially the same tone quality and output level every time the strings are tuned.

In keeping with the principles of the present invention, the objects are accomplished by a unique string vibration transducer bridge for an electric string instrument including a plurality of string tension mechanism provided side by side in the bridge and which are adjustably movable along the direction of the string and includes a plurality of string supporting electrode parts which are slidably movable along the direction of the string and rotatable along a direction perpendicular to the string, a plurality of independent piezoelectric transducers which each engage with an undersurface of an electrode part, and a plurality of piezoelectric transducers against the electrode parts whereby the tension of the string may be adjusted by both the string tension mechanism and the transducer pushing mechanism and the vibration from each string is independently sensed.

BRIEF DESCRIPTION OF THE DRAWINGS

The principles and objects of the present invention will become more apparent in the following description in conjunction with the following drawings wherein like elements are given like reference numerals and wherein.

DETAILED DESCRIPTION OF THE INVENTION

Refering more particularly to the drawings, the following is a description of an embodiment of this invention in an electric guitar with reference to FIGS. 1 through 8.

Figure 1:
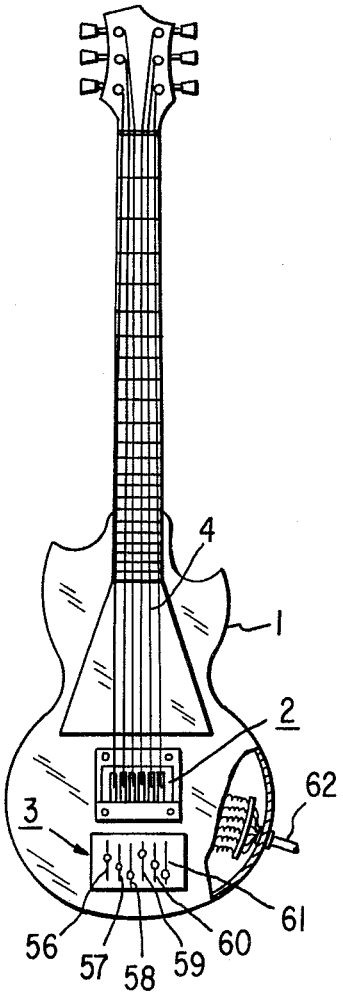
FIG. 1 is a plan view illustrating an embodiment of the string vibration transducer bridge for electric stringed instruments provided by this invention (embodied in an electric guitar)

In FIG. 1, 1 indicates the guitar body, 2 is the bridge, 3 indicates output adjusting resistors for the bridge 2, and 4 indicates six strings.

Figure 2:
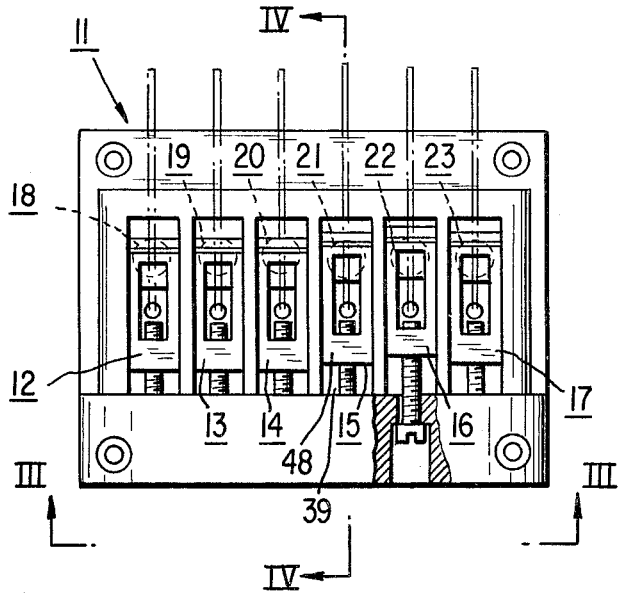
FIG. 2 is a plan view of the transducer bridge for electric stringed instruments shown in FIG. 1.
Figure 3:
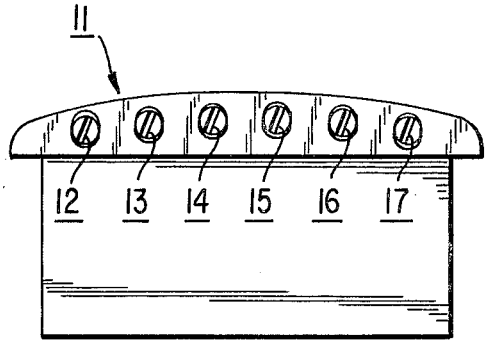
FIG. 3 is a side view from line III—III in FIG. 2.
Figure 4:
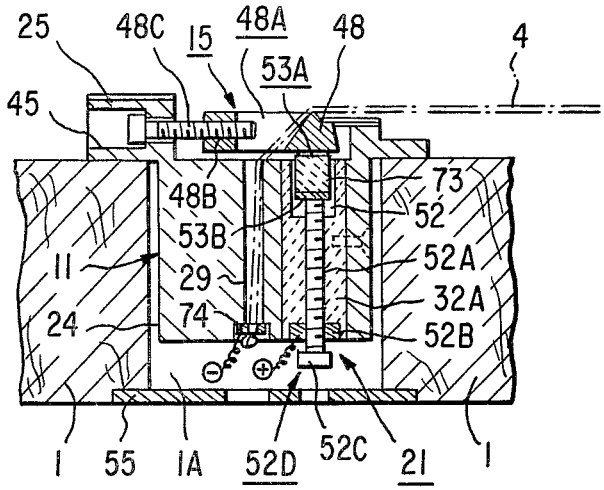
FIG. 4 is a cross section along line IV—IV in FIG. 2.

The bridge 2 is installed in an opening 1A located in the approximate center of the guitar body 1. As is shown in FIGS. 2 through 4, this bridge (2) includes a bridge base (11) which has six recesses on the side facing the strings (4), string tension adjusting mechanisms 12 through 17 which are installed inside the recesses in the bridge base (11) and which are formed so that they can move independently along the line of tension of each string and so that the outside end of each mechanism can rotate inside its respective recess in the bridge base (11), and pickups (18 through 23) which are installed in the bridge base (11) which are formed so that they support the rotating ends of the tension adjusting mechanisms (12 through 17) from the direction of the back of the body (1). The strings (4) are installed on the bridge base (11) so that they push the rotating ends of the tension adjusting mechanisms (12 through 17) toward the back of the body (1).

The following is a more detailed description of the above-described embodiment.

Figure 6:
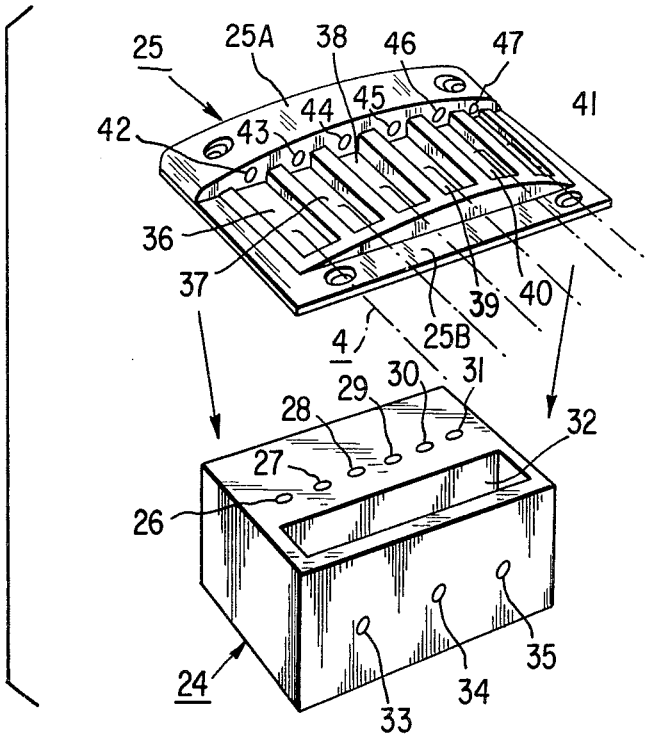
FIG. 6 is an exploded view of the bridge base shown in FIG. 2.
Figure 7:
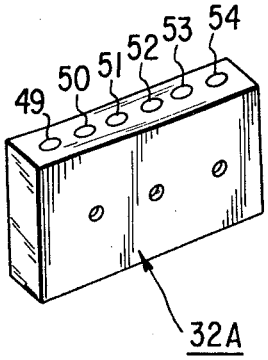
FIG. 7 is an oblique view of the pickup housing which constitutes a part of the pickup section illustrated in FIG. 2.
Figure 8:
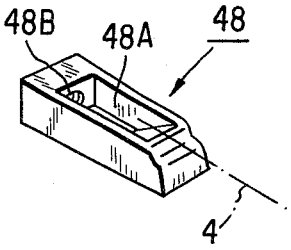
FIG. 8 is an oblique view of the string-supporting electrode part which forms a part of each of the string tension adjusting mechanisms illustrated in FIG. 2.

Bridge base (11) is made of an electrically conductive material such as aluminum, etc. As is shown in FIG. 6, the bridge base (11) consists of a bridge body (24) which is shaped in the form of a rectangular parallelopiped, and a bridge head part (25) which is attached to this bridge body (24). Conventionally, such bridge bases have been formed as a single integral unit by means of casting, etc. However, it is also appropriate to use a part that is divided in this manner. Six holes (26 through 31) for installing the strings (4) are formed at equal intervals along a line across the approximate center of the bridge body (24). A rectangular hole (32) is formed adjacent to these holes (26 through 31). A pickup housing (32A) which is a component part of the pickups (18 through 23) is installed in hole (32). Countersinks (33 through 35) for securing the pickup housing (32A) which is a component part of the pickups (18 through 23) is installed in hole (32). Countersinks (33 through 35) for securing the pickup housing (32A) are installed in the side surface of the bridge body (24) adjacent to the rectangular hole (32). The bridge head part (25) is roughly plate-shaped. The central portion bulges outwardly so that the head part (25) is slightly arc-shaped in cross section. Six rectangular holes (36 through 41) are regularly formed at equal intervals in this portion of the head part (25). The tension adjusting mechanisms (12 through 17) are installed in the rectangular holes (36 through 41). The upper surface of one end (25A) of the bridge head part (25) is formed such that it bulges outward, thus causing this end of the part to be arc-shaped in cross section like the central portion of the part. This end (25A) is uniformly higher than the central portion of the bridge head part (25). The upper surface of the other end (25B) of the part is flat. The broken lines in the figures indicate the positions of the strings (4). Elliptical seat holes (42 through 47) are formed from the exterior side surface of end (25A) of the bridge head part (25) running toward the center of each of the six rectangular holes (36 through 41). The bridge head part (25) thus formed is fastened to the bridge body (24) by means of brazing etc., thereby forming a solid bridge base (11).

FIG. 4 is a detailed illustration of the internal structure of the bridge (2). As is shown in this figure, a string-supporting electrode part (48) made of an electrically conductive material is inserted so that it is free to slide in the direction of its own length (i.e. in the direction of the string) in the rectangular hole (39) in the bridge head part (25) of the bridge base (11) (See FIGS. 4 through 8). A hole (48A) for installing the string is formed in the central portion of this string-supporting electrode part (48). A horizontal screw hole (48B) is formed in the left end (with reference to FIG. 4) of the string-supporting electrode part (48). A screw (48C), which is loosely inserted into the seat hole (45) in bridge head part (25), is screwed into this screw hole (48B). The outside end of string-supporting electrode part (48) is able to rotate up and down to a limited extent on a fulcrum formed at the point where the screw (48C) is passed through the seat hole (45). The string tension adjusting mechanism (15) is made up of the string-supporting electrode part (48), screw (48C) and seat hole (45) formed in the bridge head part (25). The remaining tension adjusting mechanisms (12, 13, 14, 16, 17) are constructed in the same manner.

The right end (with reference to FIG. 4) of string-supporting electrode part (48) is roughly triangular in cross section, with the apex of the triangle located at the top. This end is formed so that the string (4) contacts only the apex of the triangle. This insures that the purity of the string vibrations is maintained.

The pickup housing (32A), which is a component part for the pickups (18 through 23), is inserted in the hole (32) formed in the bridge body (24), and is fastened to the bridge body (24) by means fo screws. This pickup housing (32A) is made of an electrically insulating material such as a synthetic resin, etc., and is formed in the shape of a thick plate (See FIG. 7). Recesses (49 through 54) for installing piezoelectric devices are formed in a row at uniform intervals in pickup housing (32A).

The following is a description of the pickups (18 through 23) (including the pickup housing (32A)) with reference to FIG. 4 and one pickup (21) is described in detail for example.

A screw hole (52A) is formed in the central portion of the recess (52) in pickup housing (32A). A metal part (52B) for attaching a lead line is embedded in the open end (at the bottom with reference to FIG. 4) of screw hole (52A). The screw hole (52A) is formed so that it passes through metal part (52B). A long screw (52C) is inserted into this screw hole (52A) from below (with reference to FIG. 4). A roughly cylindrical peizoelectric device (73) is loosely inserted into recess (52) so that it can be caused to slide up and down (with reference to FIG. 4) by driving it with long screw (52C). A piezoelectric device pushing mechanism (52D) is formed by the screw hole (52A), screw (52C) and recess (52). The piezoelectric device (73) is installed so that its upper surface contacts the undersurface of the right end of the string-supporting electrode part (48). The surface of the piezoelectric device (73) facing the electrode part (48) bulges slightly outward so that is forms a circular arc in cross section. Accordingly, this surface can remain in constant contact with the electrode part (48) at a point near the central axis of the piezoelectric device (73) even when the electrode part (48) rotates. Therefore, changes in the pressure or vibration of the string (4) are constantly transmitted to the top of the central axis of the piezoelectric device (73), or to a point near the top of the central axis. The piezoelectric device (73) has two thin electrode plates (53A, 53B) which are attached to either end of the device. These electrode plates (53A, 53B) are made of an electrically conductive material which is highly resistant to abrasion, e.g. beryllium-copper. The string (4) is installed across the upper surface of the right end of electrode part (48), and the end of the string (4) is passed through hole (48A) and hole (29) in the bridge body (24) and anchored to a grounding part (74) installed at the lower end (with reference to FIG. 4) of the hole (29). This grounding part (74) is grounded. Thus, the vibrations of the string (4) are transmitted directly to the piezoelectric device (73) via the string-supporting electrode part (48), and the mechanical vibration pressure is converted into an electrical signal which is sent out from the metal part (52B). The remaining pickups (18, 19, 20, 22, 23) are constructed in the same manner.

Figure 5:
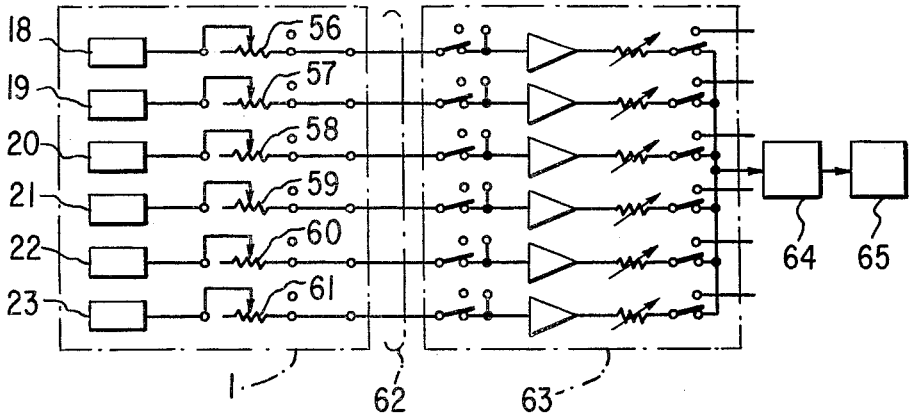
FIG. 5 is a block diagram of an embodiment of a playing system using the electric guitar shown in FIG. 1.

A metalic cover (55) is installed at the back (on the bottom surface in FIG. 4) of the opening (1A) located at the approximate center of the guitar body (1). This cover (55) is grounded so that the interior of the bridge (2) is shielded from static electricity. The output of the bridge (2) is sent out in the form of independent signals from each pickup (18 through 23). As shown in FIG. 5, these signals are sent across linear slide rheostats (56 through 61) which are equipped with switches and which are provided for each pickup. Resistors (56 through 61) are installed inside the guitar body (1). Each of the resistors (56 through 61) is installed adjacent to its corresponding string (4). The output ends of the slide rheostats (56 through 61) are connected with an electric guitar mixer via a six-core cable (62). This mixer (63) is constructed so that effects such as tremolo, phase shifting, etc., can be separately applied to the signals from each of the strings (4). The output of mixer

(63) is sent either mixed or as six independent signals to a speaker (65), etc., via an amplifier (64), etc., by means of a single-core or six-core cable. In this embodiment, resistors (56 through 61) are provided separately for each string (4) so that the output can be adjusted on a string-by-string basis. Accordingly, the player can accentuate the vibrations of a specific string by manipulating the resistors (56 through 61) while playing, and can also adopt a playing technique in which an electrical signal representing a clear chord is obtained by manipulating resistors (56 through 61) while attacking the strings as a whole. Furthermore, since the slide rheostats (56 through 61) are linear, the output level of each string (4) can be determined by visual estimation. Also, since the string tension adjusting mechanisms (12 through 17) are constructed as described above, it is possible to tune the strings (4) freely and easily without touching any string (4). In addition, since no projections are installed which project within the plane along which the strings (4) are strung, the player can play smoothly without injuring his hands. Furthermore, since the pickups are constructed and installed as described above, the vibrational force or pressure of the strings transmitted to the piezoelectric devices (53) can be freely adjusted (with the strings (4) maintained in their strung positions) merely by turning the screws (52C) from the back of the guitar body (1). Accordingly, the tension of the strings (4) can be freely adjusted by means of both the tension adjusting mechanisms (12 through 17) and the pickups (18 through 23). Furthermore, since the direction of movement of the piezoelectric devices (73) of the pickups (18 through 23) is perpendicular to the direction of the strings (4), the height at which the strings (4) are strung can be freely varied on a string-by-string basis. Accordingly, the player can easily cause specific strings (4) to vibrate more strongly than others. Also, since the contact surface of each piezoelectric device (53) takes the approximate form of a circular arc in cross section, the string-supporting electrode parts (48) of the tension adjusting mechanisms (12 through 17) will always directly transmit the vibrational pressure of the strings in the direction of the axis of each piezoelectric device (53), either to the top of the central axis of said piezoelectric device (53) or to a point near the top of said central axis, even when the outside ends of the electrode parts (48) are rotated by the pressure of the pickups (18 through 23). Accordingly, this invention is advantageous in that the vibrational force of each string is transmitted to the appropriate piezoelectrical device (53) and efficiently converted into an electrical signal no matter how the tension of the strings (4) and height at which the strings (4) are strung are adjusted. Further, since the bridge base (11) is made of aluminum and formed in the shape of a block, the invention is advantageous in that the oscillation of the point at which each string (4) is supported is reduced so that the vibrations of the strings (4) can be maintained. Furthermore, since the same or different effects can be applied to the outputs of the pickups (18 through 23) on a string-by-string basis in the electric guitar mixer (63) (as described above), the invention is advantageous in that the performing range is conspicuously expanded. In addition, the above-described design makes it possible to efficiently convert string vibrations into electrical signals regardless of the type of material from which the strings (4) are made. Furthermore, since the string side of the device is grounded, the safety of the player is assured.

In this invention, it would also be possible to divide the pickup housing (32A) into separate sections for each pickup (18 through 23), and install these sections in the bridge base (11) with a sound absorbing material inserted between and around the sides of each section. Such an arrangement would make it possible to reduce the mutual interference between the vibrations of different strings (4), and therefore to obtain a clear output signal. Furthermore, it would also be possible to make the aforementioned pickup housing (32A) of metal, and install said housing (32A) electrically insulated from the bridge base (11). Furthermore, although the abovementioned embodiment concerned an application to an electric guitar, this invention is not necessarily limited to electric guitars, but could also be applied just as it is to other electric stringed instruments such as electric basses.

In all cases it is understood that the above described embodiment is merely one of the many possible embodiments which illustrate the applications of the principles of the present invention. Numerous and other varied arrangements can be readily devised by those skilled in the art without departing from the spirit and scope of the invention.

I claim:

1. A string vibration transducer bridge for an electric instrument having strings comprising:

a bridge box;

a plurality of independent string tension mechanisms provided side by side in said bridge body and which are adjustably movable along the direction of said string, said string tension mechanism further including a plurality of independent electrically conductive string supporting electrode parts independently slidably movable in said bridge body along the direction of said strings and independently rotatable along the direction perpendicular to said string;

a plurality of independent piezoelectric transducers provided in said bridge box which each engage with an undersurface of an electrode parts to form an electrical connection therewith and are substantially perpendicular to said tension mechanisms; and a plurality of piezoelectric transducer pushing mechanisms provided in said bridge box for pushing said piezoelectric transducer against said electrode parts whereby the tension of said string maybe set by both said string tension mechanism and said transducer pushing mechanism and the vibration of each string is independently sensed.

2. A string vibration transducer bridge according to claim 1 wherein the output of each piezoelectric transducer is independently sent out from the transducer bridge.

3. A string vibration transducer bridge according to claim 2 further comprising a linear rheostats provided on said electric instrument and provided in series with the output of each piezoelectric transducer.

4. A string vibration transducer bridge according to claim 3 wherein said rheostats are sliding linear rheostats.

5. A string vibration transducer bridge according to claim 2 further comprising a pickup housing provided in said bridge body for holding said piezoelectric transducer.

6. A string vibration transducer bridge according to claim 5 wherein said bridge body is made from an electrically conductive material and said pickup housing is made from an insulative material.

* * * * *